United States Patent [19]

Check, Jr. et al.

[11] 3,990,362

[45] Nov. 9, 1976

[54] COMPUTER-RESPONSIVE SUPPLEMENTAL PRINTER

[75] Inventors: Frank T. Check, Jr., Orange; Gerald C. Freeman, Norwalk; Raymond R. Lupkas, Trumbull, all of Conn.

[73] Assignee: Pitney-Bowes, Inc., Stamford, Conn.

[22] Filed: Mar. 18, 1975

[21] Appl. No.: 559,551

Related U.S. Application Data

[62] Division of Ser. No. 195,729, Nov. 4, 1971, Pat. No. 3,832,946, and Ser. No. 377,234, July 9, 1973, Pat. No. 3,889,592.

[52] U.S. Cl. ..... 101/93.37; 197/193

[51] Int. Cl.[2] ..... B41J 3/06; B41F 1/38

[58] Field of Search ..... 83/622; 197/193, 1 R; 101/96, 93.03, 93.37–93.41, 201, 287

[56] References Cited

UNITED STATES PATENTS

| | | | |
|---|---|---|---|
| 886,936 | 5/1908 | Brock | 101/201 |
| 1,129,111 | 2/1915 | Moss | 101/201 |
| 2,255,029 | 9/1941 | Tholstrup | 197/193 |
| 2,327,646 | 8/1943 | Hutchinson | 83/622 |
| 2,813,481 | 11/1957 | Hansen | 101/287 |
| 3,561,355 | 2/1971 | Rapparlie | 197/1 R |
| 3,583,315 | 6/1971 | Hebert | 101/96 |
| 3,618,034 | 11/1971 | Hecker | 197/20 |
| 3,630,143 | 12/1971 | Price et al. | 101/287 |
| 3,700,088 | 10/1972 | Kunst | 197/193 |
| 3,742,848 | 7/1973 | Huntoon et al. | 101/93.03 |
| 3,823,667 | 7/1974 | Babler | 101/93.03 |

OTHER PUBLICATIONS

Sarbacher, Encyclopedic Dictionary of Electronics and Nuclear Engineering, P. H. Inc., 1959, p. 1182.

*Primary Examiner*—Edgar S. Burr
*Assistant Examiner*—William Pieprz
*Attorney, Agent, or Firm*—William D. Soltow, Jr.; Albert W. Scribner; Robert S. Salzman

[57] ABSTRACT

A supplemental printer is mounted piggy-back fashion atop a conventional high speed chain printer or other form of computer output printing equipment; and prints, upon the same print-out sheet as the high speed printer, information generated by the same electronic digital computer to which the high speed printer responds. The supplemental printer is capable of printing postage or other special indicia not easily incorporated into the print symbol repertoire of the high speed printer. In order to make the supplemental printer operate rapidly enough to be compatible with electronic data processing equipment, its print impression is divided into parts printed by individual type segments, each actuated by its own individual print solenoid. Some of the segments are equipped with solenoid-actuated variable numerical print modules for the purpose of printing postage or other variable numerical information. After printing, the segments return to positions at unequal levels in order to deter "wiping off" unauthorized postage or other valuable print impressions.

1 Claim, 13 Drawing Figures

COMPUTER-RESPONSIVE SUPPLEMENTAL PRINTER

RELATED APPLICATIONS

This application is a division of applications Ser. Nos. 195,729 and 377,234 filed Nov. 4, 1971 and July 9, 1973, respectively now U.S. Pat. No. 3,832,946 and U.S. Pat. No. 3,889,592 respectively.

FIELD OF THE INVENTION

This invention relates generally to the fields of postage metering and computer peripheral printing equipment. It particularly concerns a supplemental printer physically associated with a computer output printer and designed for rapid, computer-controlled printing of postage or other valuable indicia.

BACKGROUND OF THE INVENTION

In certain instances it is desireable to achieve rapid printing of computer-generated information which can not be satisfactorily handled by conventional high speed computer peripheral printers. Some applications, for example, may require special purpose indicia which are not available on conventional high speed printers, or can not be provided on such printers without unacceptable size reductions. In addition, the special purpose indicia may have certain security problems associated therewith, if the indicia have value validating significance. One application in which one or both of these problems may arise is the preparation of paychecks; and another is the printing of postage.

With regard to the postage printing application in particular, it is conventional for high volume mailers to avail themselves of the high speeds offered by modern electronic digital computers and output printers, in order to increase their output. A typical prior art installation includes a computer which is programmed to receive information as to the weight and destination of a package, and from that information to calculate the required postage. A high speed chain printer is slaved to the computer to print out the destination information on an address label which is subsequently affixed to the package.

The computer also provides the calculated postage amount information to shipping department employees in some form which enables them to affix the proper amount of postage to the package. The most common way of accomplishing this is for the high speed printer to receive the postage amount information from the computer, and print it directly on the address label for the information of the employees. This print-out is not a government-authorized postage impression of the kind provided by a postage meter. The print impression made in a prior art installation as described above includes only the postage amount without any authorized postage validation symbols, and is provided for information only. Thereafter authorized postage of like amount must be affixed by an employee by means of postage stamps or a conventional manually controlled mechanical postage meter.

The intervention of a human being, or of a mechanical postage metering device, slows down a high volume mailing operation of the kind described. Therefore it is desirable to have the authorized postage impression printed automatically in response to the computer-generated postage calculation. Some form of secure, fixed-program postage accounting equipment must also be provided.

It would be possible to use a mechanical postage meter which comprises a secure housing containing authorized postage printing means, a mechanical descending register for storing the postal credit balance, and mechanical means for guaranteeing that all printed postage amounts are decremented from the register. An electrically actuated controller device may then be provided to translate electrical signals from the computer into mechanical inputs for controlling all meter functions.

The latter approach meets all security requirements, but is considered too slow to meet the speed requirements of some high volume mailing operations. When used in conjunction with an electronic digital computer and high speed printer, it may be necessary for the postage printer to produce approximately two or three postage impressions per second. Mechanical postage meters, however, typically are motor-driven printing devices with mechanical postage-amount-changing mechanisms. Their maximum output rate, about two postage impressions per second, is barely adequate for the application described. Moreover, their output rate drops to about half of that maximum if it is necessary to change the postage amount between print cycles. Thus the utility of mechanical meters in data processing environments is largely limited to fixed-postage-amount applications.

It is possible to use the printing capability of the high speed printer itself for postage purposes, by making appropriate modifications such as replacing standard print characters by special postage symbols. That approach, however, runs into the problem of character size limitations which are inherent in standard high speed printing equipment. It also involves undesirable interference with the electrical interface between the computer and the high speed printer, i.e., breaking into the electrical cable which connects the computer and the high speed printer in order to insert special circuitry for performing postage security accounting functions. It is also necessary to house the printer and the postal accounting circuitry in a large security enclosure to prevent cheating by an unscrupulous computer programmer.

SUMMARY OF THE INVENTION

In accordance with this invention, these problems and disadvantages are circumvented by mounting a supplemental printer atop the conventional computer output printer, in position to print special purpose indicia upon the same print-out sheet. In security-sensitive applications such as the printing of authorized postage or paychecks, security of electronic accounting procedures is achieved by providing separate electrical control connections to the conventional computer output printer and to the supplemental value-printing device respectively. Therefore this approach also avoids the need for breaking into the electrical interface between the computer and its standard peripherals.

According to another aspect of the invention, the speed limitations of conventional postage printing mechanisms are circumvented by providing a segmented, solenoid-actuated postage printing mechanism, in which the entire postage impression field is divided into individual parts each printed by an independently actuated type slug, and each slug is independently actuated by its own solenoid. The individual segments are fired in sequential relationship, in order to improve the print quality. For application where numerical values are concerned, individual print segments are provided with solenoid-operated variable numerical amount printing modules. In order to deter wiping off of unauthorized print impressions that have postal or other economic value, the type face surfaces of the print segments are maintained at different levels when in their home positions, so that it is difficult to reach the recessed surfaces.

DETAILED DESCRIPTION OF THE PREFERRED EMBODIMENT

Figure 1:
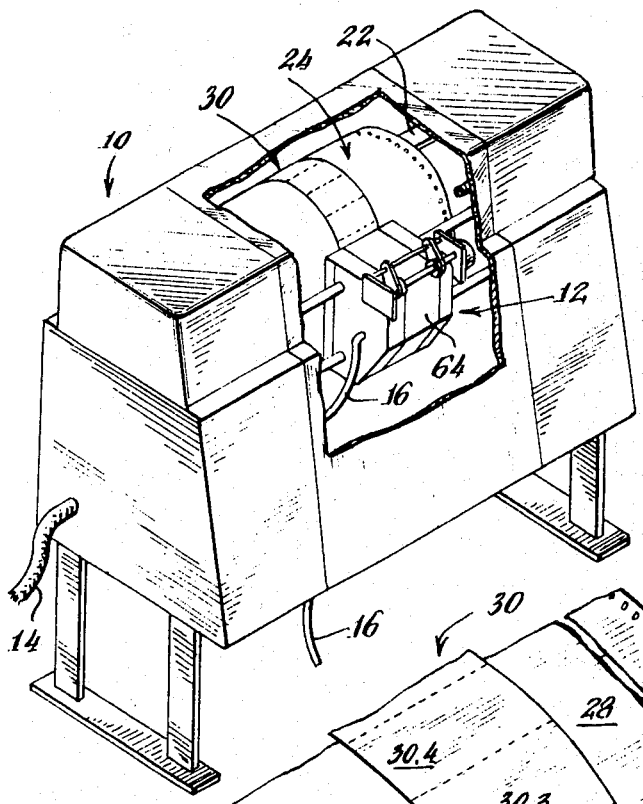
FIG. 1 is a perspective view of a computer output printer having a supplementary authorized postage printing accessory mounted thereon in accordance with this invention. The cover of the computer output printer has been partially broken away for clarity of illustration.

FIG. 1 illustrates a high speed computer output printer 10 having an auxiliary printing mechanism 12 mounted thereon. The computer output printer 10 may be any standard form of high speed printer of the kind which is normally driven by an electronic digital computer in conventional data processing installations. The particular high speed printer 10 illustrated here is basically a standard IBM Model 1403 chain printer which has been modified only to the extent necessary to mount the supplemental printer 12 thereon.

The supplemental printer 12 may be designed to print any of a variety of special purpose indicia which, for one reason or another, are not printed directly by the chain printer 10 itself. In the case of special validating symbols for postage impressions or paychecks, it may be important from the standpoint of readability that the validating symbol be larger than the type face capacity of the chain printer 10. Or one may wish to avoid the loss of a standard print symbol by replacement with a postage validation symbol. Or in the case of numerical value dispensing applications, such as postage or paycheck printing, a separate printing mechanism may be desirable in order to have separate electrical data input leads for controlling both the high speed printer 10 and the supplemental printer 12, in order that accounting problems associated with the supplemental printer 12 in these applications may be handled by secure, fixed-program, special purpose electronic circuitry without the need for disrupting the data connection between the computer and its high speed printer 10. Thus, in the illustration of FIG. 1 the high speed printer 10 and the supplemental printer 12 receive their data inputs over separate data input cables 14 and 16 respectively.

In this specification the supplemental printer 12 will be discussed in terms of an authorized postage printer used in computer-controlled high volume mailing operations; but it will be readily appreciated that many of the security and accounting problems are the same for other value-dispensing applications such as the preparation of paychecks. The supplemental printer 12 mounted upon the computer output printer 10 is only the postage printing portion of an authorized postage metering system. In order to make such an installation complete, the other end of the data input cable 16 is connected to an electronic postage metering circuit (not shown) which performs the necessary postal accounting functions under secured conditions. The cable 16 is a secured cable, the postage printer 12 is enclosed in a secure housing 20, the metering circuit is also enclosed in a secure housing, and the cable 16 is connected to the metering circuit by a secured connector. For a complete disclosure of the design of such secured cables and connectors, and of an electronic postage metering and printing system which employs the supplemental printer of this invention and deals fully with the postal security and accounting problems involved, see U.S. patent application Ser. No. 406,898 filed Oct. 16, 1973, by Eckert, Jones, Hinman, McFiggans, Check and Lupkas, and assigned to the assignee of the present application.

The chain printer 10 impresses printed data upon a paper web 24 in response to computer-generated signals received over the data cable 14. The paper is advanced through the printer line-by-line by means of conventional paper tractors (not shown) acting upon sprocket holes 26 along either edge of the paper web. For mailing label applications, the paper web 24 comprises a backing sheet 28 which has the sprocket holes 26 punched therein and is wide enough to engage the paper tractors on either side of the printer 10, plus a centrally located front strip 30 which is narrower and consists of a series of individual mailing labels 30.1, 30.2, etc.

Printing by the chain printer 10 takes place somewhat below the level of the supplemental postage printer 12, and after each segment of the mailing label strip 30 is completed the paper web 24 is pulled upwardly by the tractors. At a somewhat higher location within the printing station of the high speed printer, the supplemental printer 12 makes its postage printing impression upon the same mailing label strip 30, in response to data which arrives over the secured cable 16 and advises the postage printer of the computer-calculated amounts of postage required for each package. Because of their different print locations along the path of the paper web, there is a time difference between the related printing operations of printers 10 and 12, of which the computer must be programmed to take account. After both printing mechanism 10 and 12 have finished printing their respective impressions thereon, the label strip 30 is separated from the backing sheet 28 and divided into individual mailing labels, 30.1, 30.2, etc. which are then affixed to respective packages for mailing.

Figure 2:
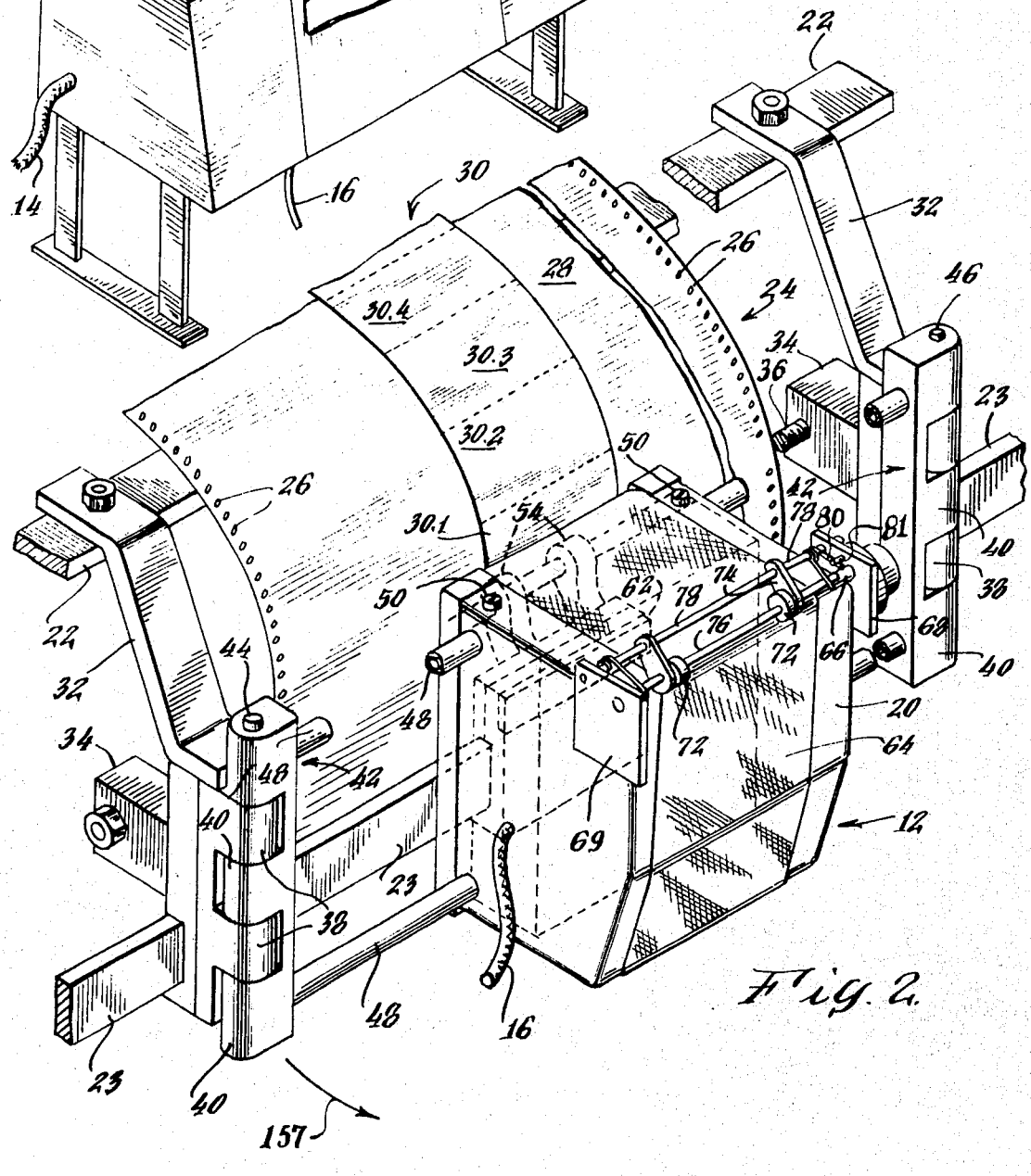
FIG. 2 is an enlarged perspective view of the supplemental printer of FIG. 1, and the supporting structure which mounts it on the computer output printer.

The conventional frame structure of an IBM Model 1403 chain printer 10 includes a pair of upper and lower frame members 22 and 23 respectively which extend horizontally across the printing station, and are used as the basic support for the supplemental postage printer 12 (FIG. 2). A pair of side bars 32 are each bolted at their upper ends to the upper frame member 22 and at their lower ends to the lower frame member 23 of the main printer 10. At their lower ends, these side brackets 32 are formed with rearwardly projecting bar-supporting lugs 34 which receive the opposite ends of a threaded bar 36, and forwardly projecting hinge lugs 38 which interengage with hinge lugs 40 formed on a pair of end brackets 42. Hinge pins 44 and 46 pass downwardly through vertical holes which are drilled through all the hinge lugs 38 and 40 to secure the end brackets 42 to the side brackets 32 at either side of the printing station (see also FIGS. 3 and 6). The supplemental postage printer 12 is supported on a pair of slide rails 48 which extend horizontally between the two end brackets 42, and permit the postage printer 12 to slide horizontally to a position of printing relationship with the label strip 30. Set screws 50 hold the printer 12 in place after initial adjustment.

Figures 4, 8, 9:
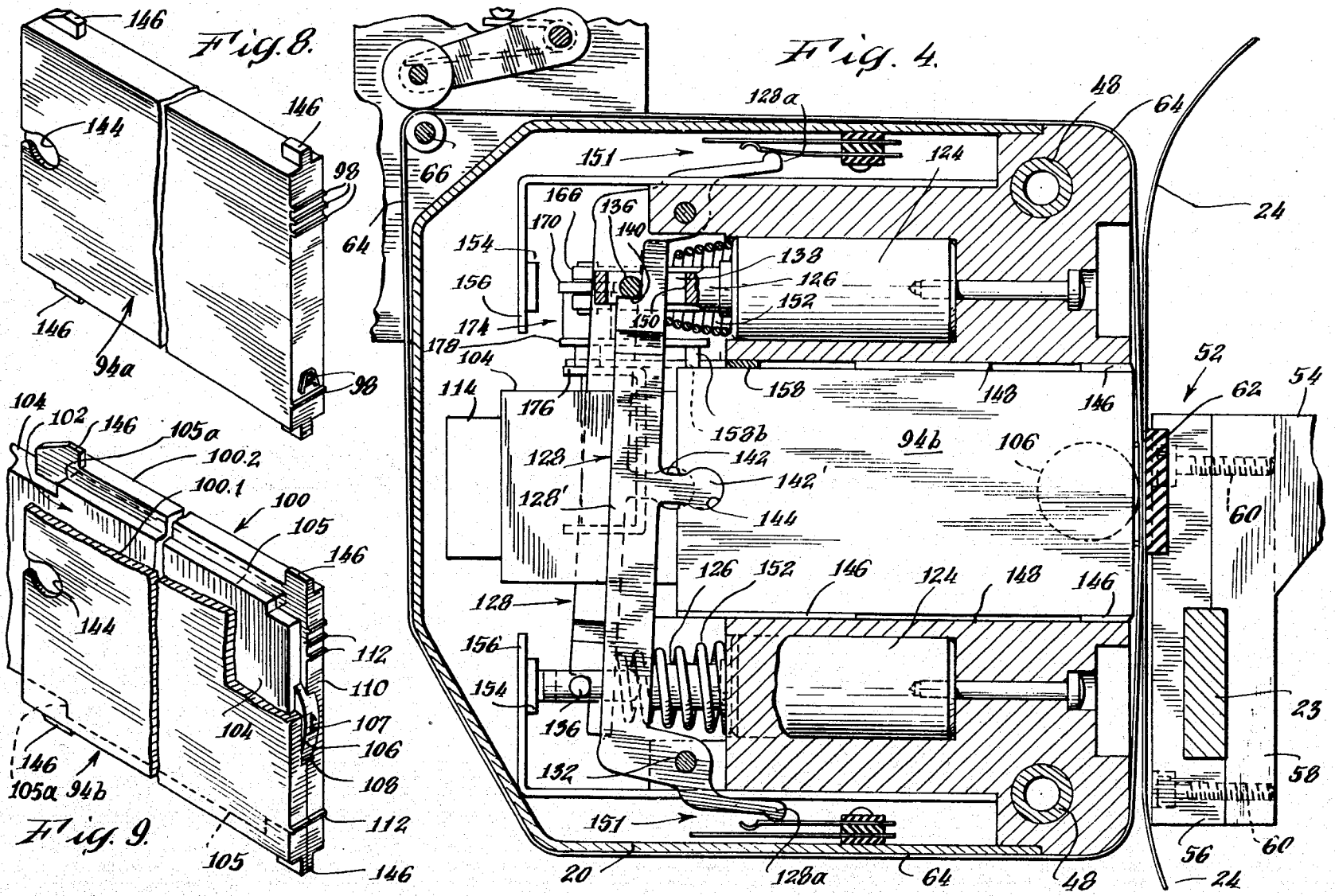
FIG. 4 is a sectional view taken along the lines 4—4 of FIG. 3, looking in the direction of the arrows.
FIG. 8 is a perspective view of a fixed information printing slug which forms one part of the authorized postage impression of FIG. 10.
FIG. 9 is a similar perspective view, with parts broken away for clarity of illustration, of a variable numerical information printing slug which forms another part of the postage impression.
Figures 6, 7:
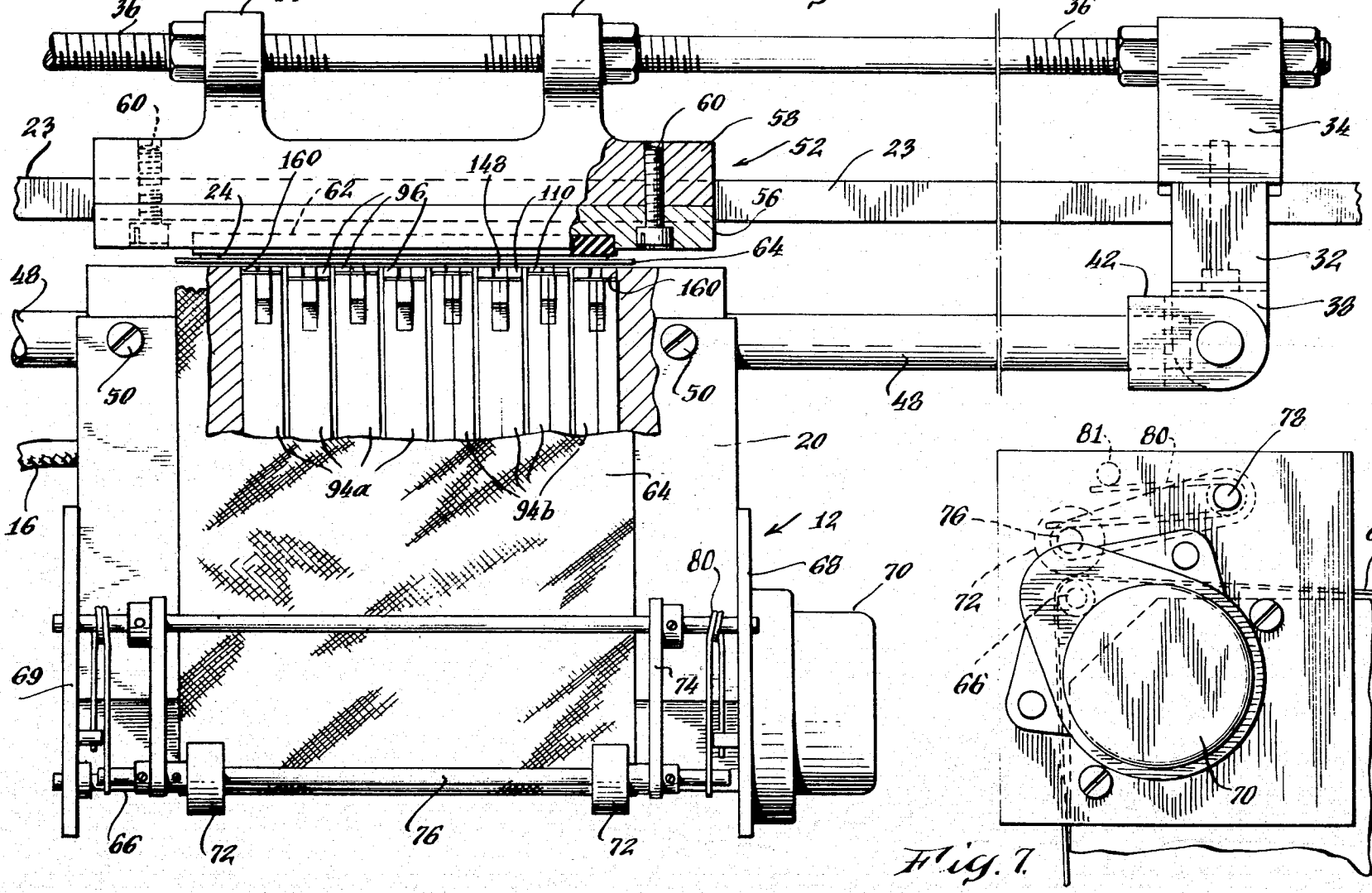
FIG. 6 is a top plan view of the supplemental printer and portions of the mounting mechanism of FIG. 2, with parts broken away for clarity of illustration.
FIG. 7 is an elevational view of the ink ribbon advance mechanism of the supplemental printer.

As best seen in FIG. 6, a special platen assembly 52 for cooperating with the postage printer 12 is located directly behind the paper web 24, and is supported, with provision for lateral position adjustment, by threaded engagement with the bar 36 and clamping engagement with the lower frame member 23. The threaded engagement with the bar 36 is accomplished by a pair of upwardly and rearwardly extending tapped lugs 54. The clamping engagement with the lower frame member 23 is accomplished by front and rear plates 56 and 58 respectively which surround the lower frame member 23, as seen in FIGS. 4 and 6. Bolts 60 passing through the front plate 56 are threaded to the rear plate 58 to secure them in clamping relationship about the lower frame member 23. The actual platen surface is a hard rubber insert 62 which is received within an appropriate recess on the front surface of the front clamping plate 56.

An inked ribbon 64 passes entirely around the outside of the postage printer housing 20 and downwardly between the postage printer mechanism 12 and the paper print-out sheet 24, in order to provide ink for postage impressions. As seen in FIGS. 2, 6 and 7, the ribbon 64 is advanced continuously by a roller 66 journaled between plates 68 and 69 and driven by a ribbon advance motor 70 secured to the plate 68. Both plates 68 and 69 are mounted on the exterior of the housing 20. Idler rollers 72 are rototably mounted on shaft 76 carried by links 74, and the links in turn are pivotally mounted upon a shaft 78 journaled between the mounting plates 68 and 69. Torsion springs 80 are wrapped around shaft 78 and react against pins 81 and shaft 76 for biasing the idler rollers 72 against the ink ribbon 64 to maintain driving engagement with the motor-driven roller 66.

The speed of the computer output printer is such that it can turn out about two or three mailing labels per second. Therefore, if the supplemental postage printer 12 of this invention is to be compatible, it must be able to make two or three postage impressions per second. Conventional mechanical postage printing mechanisms, of the kind that are now widely used for postage metering, are barely capable of such operating speeds, and only under certain limited conditions. Conventional postage printing mechanism are motor-driven. The inertia of the mechanism and the looseness of the mechanical linkages between the motor and the type elements is such that a print cycle typically takes about half a second when the fastest mechanical postage printers are used. Ideally, then, such printers can turn out two labels per second; but only if the postage amount is not changed between print impressions. Changing the postage amount in a mechanical postage meter typically consumes an additional half second in the fastest mechanical devices, thus increasing the total cycle time to a full second. Consequently, in variable postage applications the production rate would drop to little more than one label per second. The present invention avoids these problems by providing a fast, fully solenoid-operated postage amount changing and printing mechanism which has low inertia and a direct coupling to the type elements.

In addition, most motor-driven postage meters employ a rotary printing action. In addition to the inertia and loose coupling problems mentioned above, rotary mechanisms have dynamic balance problems when operated a high speed. The present invention avoids that problem by providing a flat bed postage printer, i.e., one in which the type elements have a linear print motion. Flat bed printers have been employed for postage dispensation in the past, but they suffered from high inertia and slow response, not only because they were motor-driven, but also because the entire postage impression was formed by one massive, large-area type element. In contrast, the present invention employs a segmented printing mechanism in which the area of the postage impression is divided into a plurality of parts, each of which is printed by an independently moveable type slug actuated by its own individual solenoid. As a result, the printing forces and the inertial mass which each solenoid must handle are drastically reduced. The invidividual printing slugs also have their own individual return spring mechanism, to reduce the inertial problems affecting return of the print mechanism, and thus contribute to the overall operating speed of the mechanism.

Figure 10:
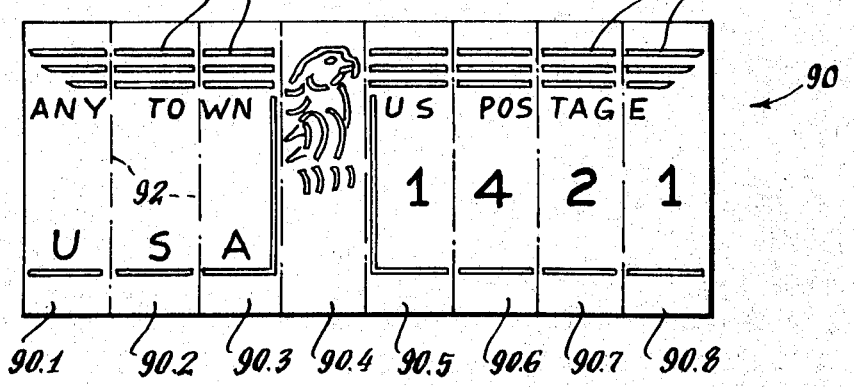
FIG. 10 is an enlarged illustration of an authorized postage impression made by the supplemental printer.

As seen in FIG. 10, an entire postage field 90 to be printed by the mechanism of this invention is divided into a plurality of parts 90.1 – 90.8 separated by boundaries 92 (these boundaries are imaginary; they are shown only to indicate the division of the overall postage field 90, and are not actually visible when postage is printed). Each of the segments 90.1 – 90.8 is printed by an individual type slug **94*a*; 94*b*. Examples of two different types of printing slugs 94*a* and 94*b* which are employed to make the print impressions for the segments 90.1 – 90.8 are seen in FIGS. 8 and 9 respectively. The slug 94*a* illustrated in FIG. 8 is of the kind used to make the printing impressions for the first four segments 90.1 – 90.4, which contain only fixed subject matter such as part of the postage validating symbol, geographical information, etc. The segment 94***b* illustrated in FIG. 9 is of the kind used to print the last four segments 90.5 – 90.8, which contain the remainder of the postage validating symbol plus variable numerical data (e.g. 1421) for forming the postage amount.

Each of the fixed information print slugs 94*a* is a generally rectangular solid member having a narrow end surface 96 formed with type face elements 98 for printing the fixed portion of the postage impression 90. Each of the variable data print slugs 94*b* comprises a jacket 100 of similar external shape but formed in two halves 100.1 and 100.2 shaped to define a rectangular hollow interior 102 into which is inserted a variable numerical print module 104. The module 104 comprises a rotatable wheel 106 having a set of numerical type face elements 107, one of which protrudes through a window 108 formed in the end surface 110 of the slug. Above and below the number window 108 are additional type face elements 112 which cooperate with the type face elements 112 and 98 of other slugs 94*a;* 94*b* for printing the fixed portion of the postage impression 90. The fixed information type face elements 98 and 112 on the fixed and variable slugs 94*a* and 94*b* respectively are aligned with each other so as to form mating lines 113 in the postage impression 90 as seen in FIG. 10. The variable number modules 104 are formed with ribs 105 above and below, which are received by complementary-shaped recesses formed internally of the respective halves 100.1 and 100.2 of the variable print slug jacket 100, so that end surfaces 105*a* of these ribs retain the variable number modules 104 within the print slug interiors 102 against the force of print impact exerted against the number wheels 106.

Figure 11:
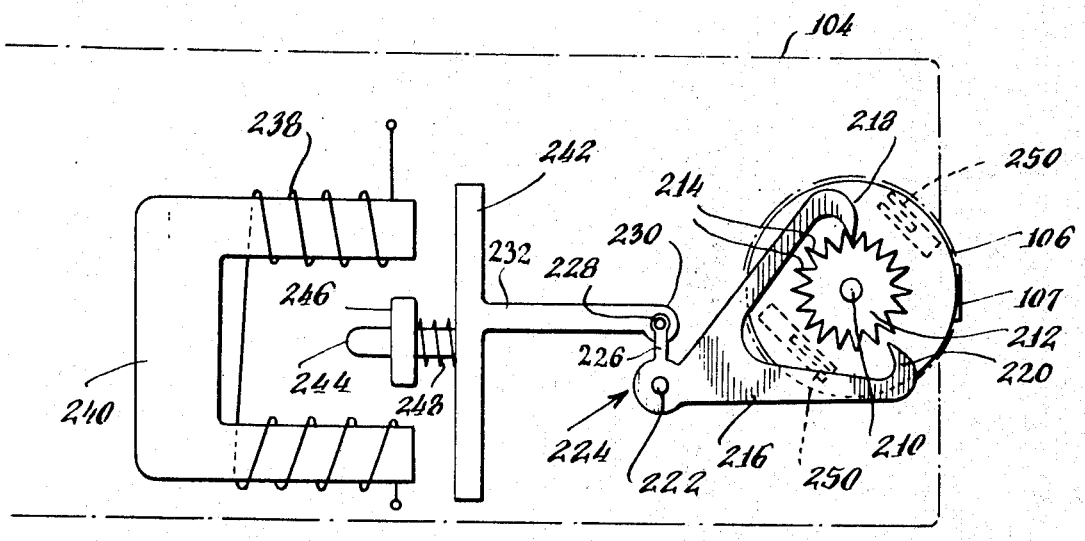
FIG. 11 is a schematic illustration of a solenoid and ratchet drive mechanism for one of the number wheel modules in the printing slug of FIG. 9.

The variable number modules 104 are commercially available, for example from Practical Automation Company of Shelton, Conn. As seen in FIG. 11, they include respective number selection solenoids 238 for rotating the number printing wheels 106 to a desired numerical position, and respective printed circuits 114 which protrude from the slugs 94*b* (see FIG. 4) and have electrical leads for conducting number selection input signal to the number selection solenoids and number verification output signals for data feedback to the computer. These leads permit a computer connected to the data cable 16 to send signals to the variable number wheels modules 104 to select the amount of postage, and to receive back signals which verify whether or not the postage amount has been correctly set.

The number wheel 106 is rotatably mounted upon a shaft 210. Coupled to the wheel 106 for rotation therewith is a ratchet wheel 212 having a plurality of peripheral teeth 214. A two-pronged drive pawl 216 includes an upper tooth 218 and a lower tooth 220. Pawl 216 is fixed upon a horizontal shaft 222 for rotation therewith. Also fixed to that shaft is a rocker crank 224 having a crank arm 226 and a drive handle 228 at the end of the arm. The handle is substantially circular in configuration and is rotatably embraced by a drive collar 230 formed at the end of a drive link 232. The link is reciprocated by means of a solenoid 238 which is wound on a U-shaped iron core 240. When the core is energized, the core attracts an armature 242 which is affixed to the drive link 232. The armature 242 has a guiding pin 244 which passes through a suitable opening in a fixed guide member 246. A biasing spring 248 is coiled about the guide pin 244, and compressed between the armature 242 and the guide member 246. In operation the number wheel 106 is advanced one numerical step by the pawl 216 for each electrical drive pulse applied to the coil 238. The coil 238 is energized from the printed circuit 114, and wiper contacts 250 mounted on the wheel 106 cooperate with the printed circuits 114 to reveal the numerical position of the wheel 106.

This type of solenoid-actuated number wheel setting mechanism is very much faster than the mechanical linkages used for postage amount changing in present-day postage meter mechanism. In actual tests of equipment constructed according to this invention, it has been determined that under worst case condition (i.e. if number wheel rotation is unidirectional and the resetting displacement in a given instance is only one less than the total number of numerical increments), the maximum resetting time is 140 milliseconds, compared to 500 ms. for prior art mechanisms having mechanical number wheel resetting linkages.

Figure 3:
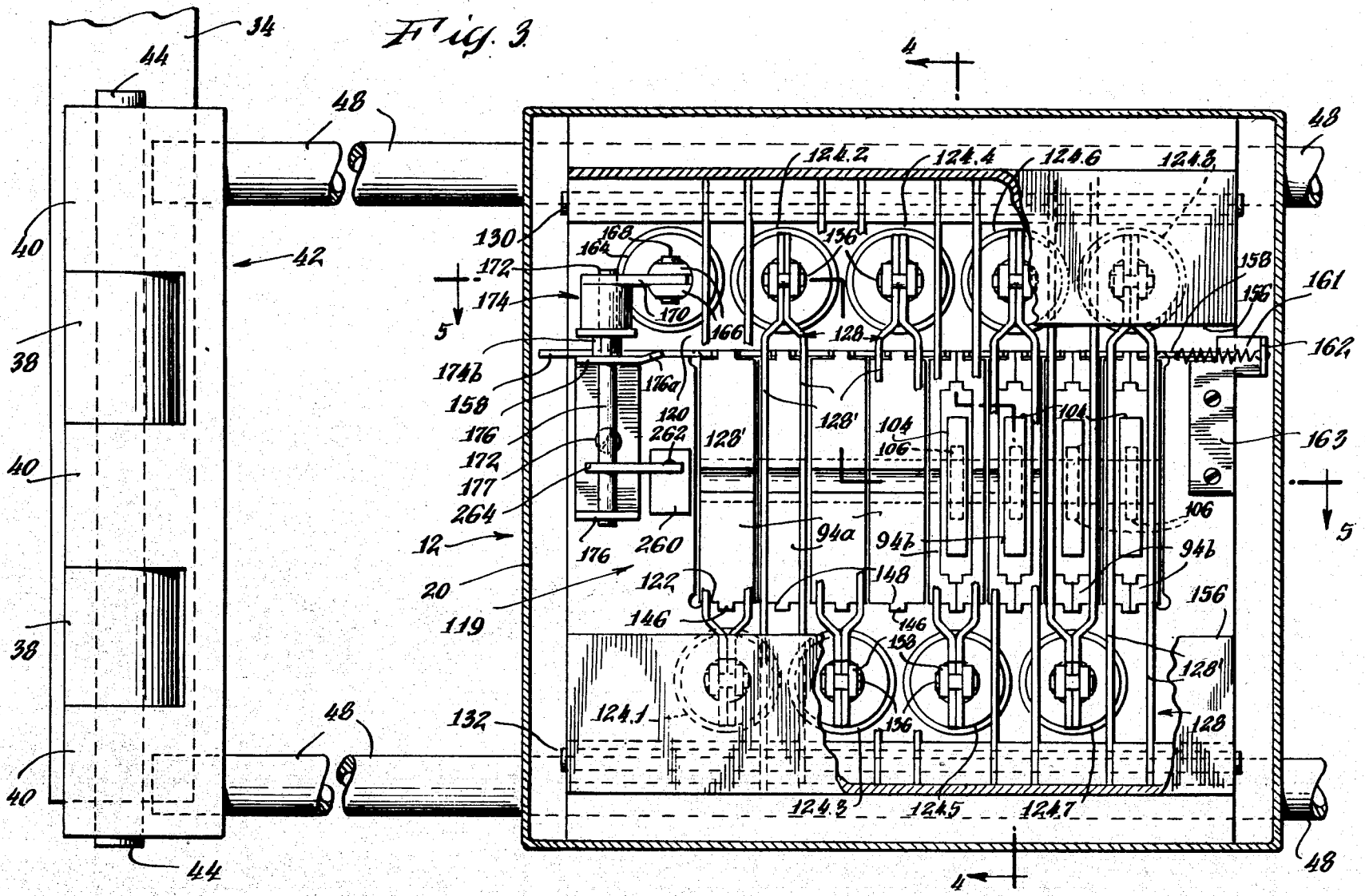
FIG. 3 is a vertical section taken through the supplemental printer of FIG. 2.
Figure 5:
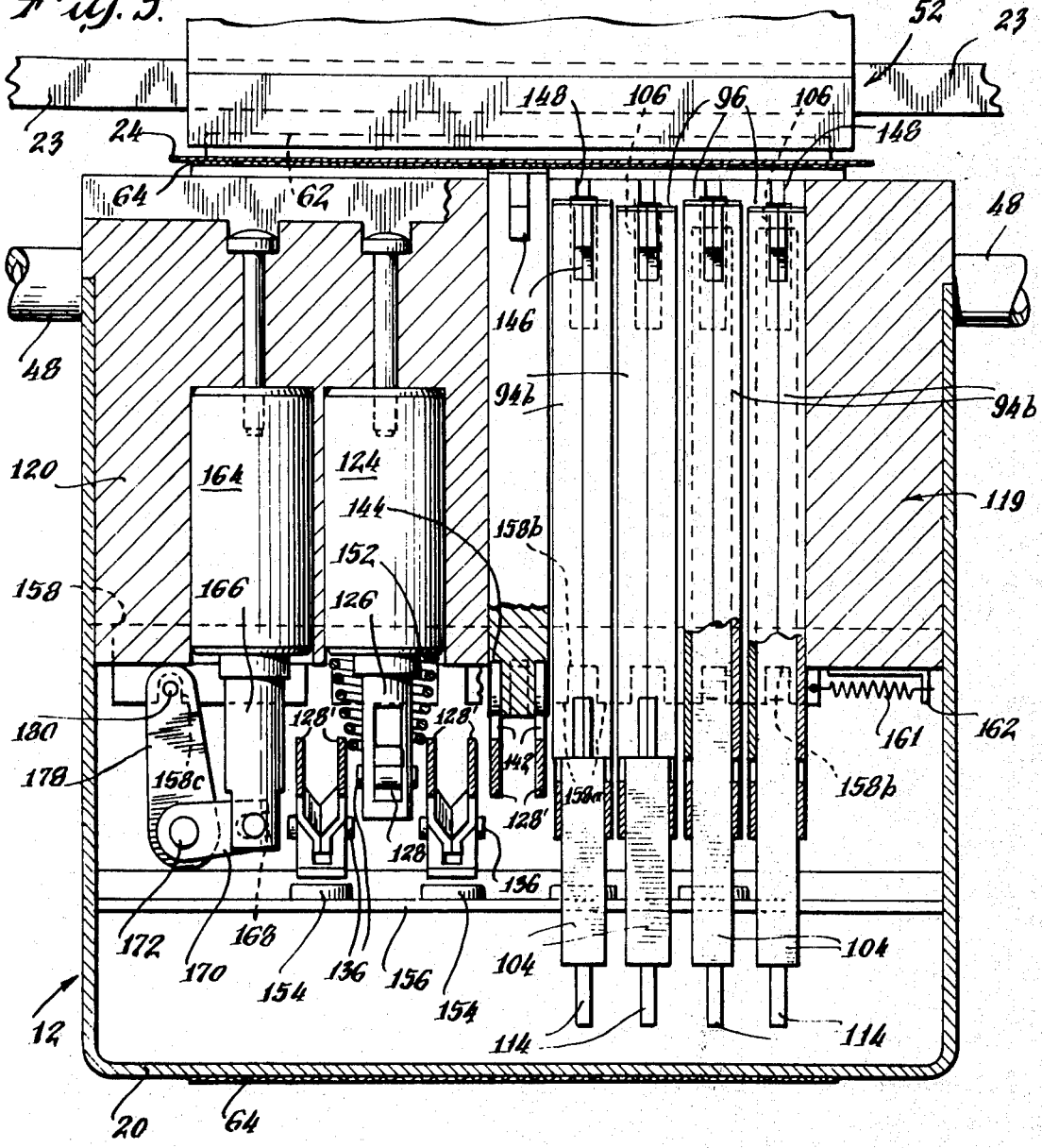
FIG. 5 is another sectional view, this time taken along the lines 5—5 of FIG. 3, looking in the direction of the arrows.

As best seen in FIGS. 3, 4 and 5, the printing mechanism is mounted on a U-shaped machine guide block 119 contained within the secure housing 20 and having upper and lower wings 120 and 122 respectively which are spaced apart to define a print slug guideway between them. As seen in FIG. 3, eight print solenoids 124.1 – 124.8 are mounted within appropriate recesses formed in the guide block. In order to avoid crowding, the odd-numbered solenoids 124.1 – 124.7 for four alternately aligned spaced print slugs 94*a;* 94*b* are mounted on one guide block wing 122, and the even-numbered solenoids 124.2 – 124.8 for the intervening print slugs 94*a;* 94*b* are mounted on the other guide block wing 120.

Each solenoid 124 has a plunger 126 which moves to the right (as seen in the view of FIGS. 4 and 5) at the time of solenoid energization. For each print slug 94*a;* 94*b* and its actuating solenoid 124, there is a bail assembly 128 (FIGS. 3 and 4) which is pivoted at one end by means of pivot shafts 130 or 132 secured at opposite ends to the housing 20. Each bail assembly 128 is engaged at the opposite end by a connecting pin 136 passing between two spaced lugs 138 formed on each solenoid plunger 126.

As best seen in FIG. 3, each bail assembly 128 comprises a pair of individual bail members 128′ which are spaced apart where they are pivoted to the shafts 130 and 132 and where they pass over the print slugs 94*a;* 94*b;* but which meet where they pass between the two lugs 138 of the solenoid plungers 126. The connecting pins 136 pass over the bail members 128′, and nest within notches 140 formed in the bail members as best seen in FIG. 4. Thus, as the solenoid plungers 136 move to the right, the pins 136 rotate the free ends of the bail assemblies 128 pivotally about their respective shafts 130 and 132.

The mid-portions of each bail member 128′ are formed with lugs 142 having circularly shaped tips 142′ received within a pair of circularly shaped openings 144 on each print slug 94. The variable number printing modules 104 are substantially longer than the print slug jackets 100, and therefore extend beyond the associated bail assemblies 128 (as seen in FIG. 4). Spacing the individual bail members 128′ apart allows a central clearance space for the variable print modules 104 (see FIG. 3). In addition, the use of two laterally spaced bail members 128′ causes the tips 142 (FIG. 4) to exert actuating forces evenly on both sides of the associated print slugs 94*a;* 94*b,* so that there are no unbalanced dynamic forces during printing.

As seen in FIGS. 4, 6, 8 and 9, the print slugs 94 are formed with front and rear guide lugs 146 at opposite sides thereof, which mount the slugs 94*a;* 94*b* for sliding motion by slipping into guide recesses 148 formed in the faces of the guide block wings 120 and 122 (FIG. 3). Thus the motion of the print slugs 94*a;* 94*b* is translational in nature, as they reciprocate along the paths defined by the guide recesses 148. The motion of the bail assemblies 128 is pivotal about their shafts 130 and 132, but the circular shape of the drive lugs tips 142' (FIG. 4) and of their receiving recesses 144 assures that the force exerted by the bail assemblies 128 upon the print slugs 94*a;* 94*b* will always be parallel to the direction of print slug motion.

The print mechanism is designed so that the solenoid plunger 126 bottom before the print slugs 94*a;* 94*b* make printing impact. As a result, the slugs 94*a;* 94*b* then coast through the remainder of their printing travel momentarily uncoupled from the solenoids 124. This allows the slugs 94*a;* 94*b* to make a brief printing impact against the ink ribbon 64, paper 24 and platen 62, and then to rebound cleanly for the sake of high print quality. In FIG. 4, solely for the purpose of illustration, the bail assembly 128 at the left is seen in its returned position prior to solenoid actuation, and the other bail assembly 128 is seen displaced to the right and at the point of uncoupling. Note that the space between plunger surface 150 and bail assembly 128 allows the bail sufficient clearance to coast free of the connecting pin 136.

For particular applications in which the printer of this invention is controlled by general and/or special purpose computing equipment to keep account of postage or other value dispensed by printing, it would be desirable to have some means of confirming that the print operation ordered by the computing equipment has actually taken place, so that corrective measures can be taken in the event that some malfunction prevents printing. Thus the bail assemblies 128 are provided with heel extensions 128a which are arranged to close normally open print confirmation switches 151 only when the bail assemblies are at or near the position corresponding to print impact of the slugs 94*a;* 94*b*. The switches 151 illustrated in FIG. 4 are of the leaf-sprung type, mounted on the interior wall of housing 20. But if desired, magnetically actuated glass-enclosed reed switches could be used for print confirmation purposes. In either case, contact bounce problems can be eliminated by using the electrical outputs of the print confirmation switches to latch conventional bistable circuits, which then store print confirmation data until reset.

The return motions of the bail assemblies 128 and print slugs 94*a;* 94*b* are driven by coil springs 152 which surround the solenoid plungers 126 and are compressed between the bail assemblies 128 and the solenoids 124 in order to store mechanical energy as the solenoid is actuated. The spring-biased return of the bail assemblies 128 allows the print confirmation switches 151 to re-open, and also causes the solenoid plungers 126 to return because of the driving connection made via pins 136. Return motion of the plungers 126 is limited by cushions 154 mounted on L-shaped stop brackets 156.

With reference to FIGS. 2 and 3, it is occasionally necessary to swing the supplemental postage printer 12 out of the way in order to provide access to paper web 24, the printing chain or other portions of the high speed printer 10. This is accomplished by removing either one of the hinge pins 44 or 46 and swinging the entire assembly of the postage printer 12, the slide rails 48 and the end brackets 42 outwardly about the remaining hinge pin 44 or 46. The arrow 157 in FIG. 2, for example, illustrates the outwardly swinging motion of this assembly about the hinge pin 46 which could be accomplished if hinge pin 44 were removed. In FIGS. 5 and 6 it is seen that the printing slugs 94*a;* 94*b* protrude through a window 160 in the rear of the postage printer housing 20, so as to have printing access to the inked ribbon 64, paper web 24 and platen 62. Clearly, when the piggy-bank printer assembly is swung out about one of its hinge pins as just described, this will provide easy access to the inked ribbon 64 and the postage printing type faces 98, 107 and 112 of the print slugs 94*a;* 94*b*. This situation creates a temptation for postage fraud by "wiping off"; i.e., by pressing paper against the inked ribbon and postage printing type faces to accomplish an artificial postage printing impression without actuation of the print solenoids, and therefore without decrementing the electronically stored postal accounting balance.

In order to prevent such cheating, the printing mechanism is so arranged that when all print slugs 94*a;* 94*b* are in their return positions the postage printing type faces are in different planes. This is clearly seen in FIGS. 5 and 6, where the type-face-bearing surfaces 96 and 110 of the slugs 94*a;* 94*b* are seen to be unequally spaced from the printing platen 62. It is not necessary for the printing surface of each slug to be in its own plane. It suffices, and simplifies the mechanical design, if there are at least two different planes, the type faces of some slugs being in one plane which is relatively close to the platen, and the type faces of at least one other slug being in another plane which is further from the printing platen. Thus one or more of the slug surfaces 96 or 110 is recessed relative to the others. The amount of separation of the two planes, i.e. the degree of recessing, is made large enough in relation to the breadth of the slug surfaces 96 and 110 so that it is difficult to reach the more recessed of these surfaces to wipe off an unauthorized postage impression therefrom. In addition, the slug 94*b* containing the least significant digit of numerical information is recessed the most. Although worth the least, that digit is always used, and is therefore the most indispensable of all digits if the postage impression wiped off is to look authentic.

The described uneven placement of the slug surfaces makes it difficult to obtain a fraudulent postage impression, but this advantage would be lost if a postage thief could force the print slugs 94*a;* 94*b* into alignment with each other, thus forming a planar printing surface. Other features of this mechanism, however, prevent that from happening.

First, it is not possible to force the more exposed print slugs 94*a;* 94*b* backwardly, in the direction opposite to their print stroke. If this were attempted, the print slugs would only force their drive bail assemblies 128 against the connecting pins 136, which in turn would force the solenoid plungers 126 against their L-shaped stop brackets 156.

The opposite approach, that of forcing the recessed print slugs to move outwardly in the direction of the printing stroke, is also difficult. In addition to the secured housing 20 which makes access to the internal mechanism very difficult, there is also a locking mechanism which prevents any of the slugs 94*a*, 94*b* from moving through any portion of their print stroke unless an unlocking command comes from the computing equipment over the secured cable 16.

Figure 12:
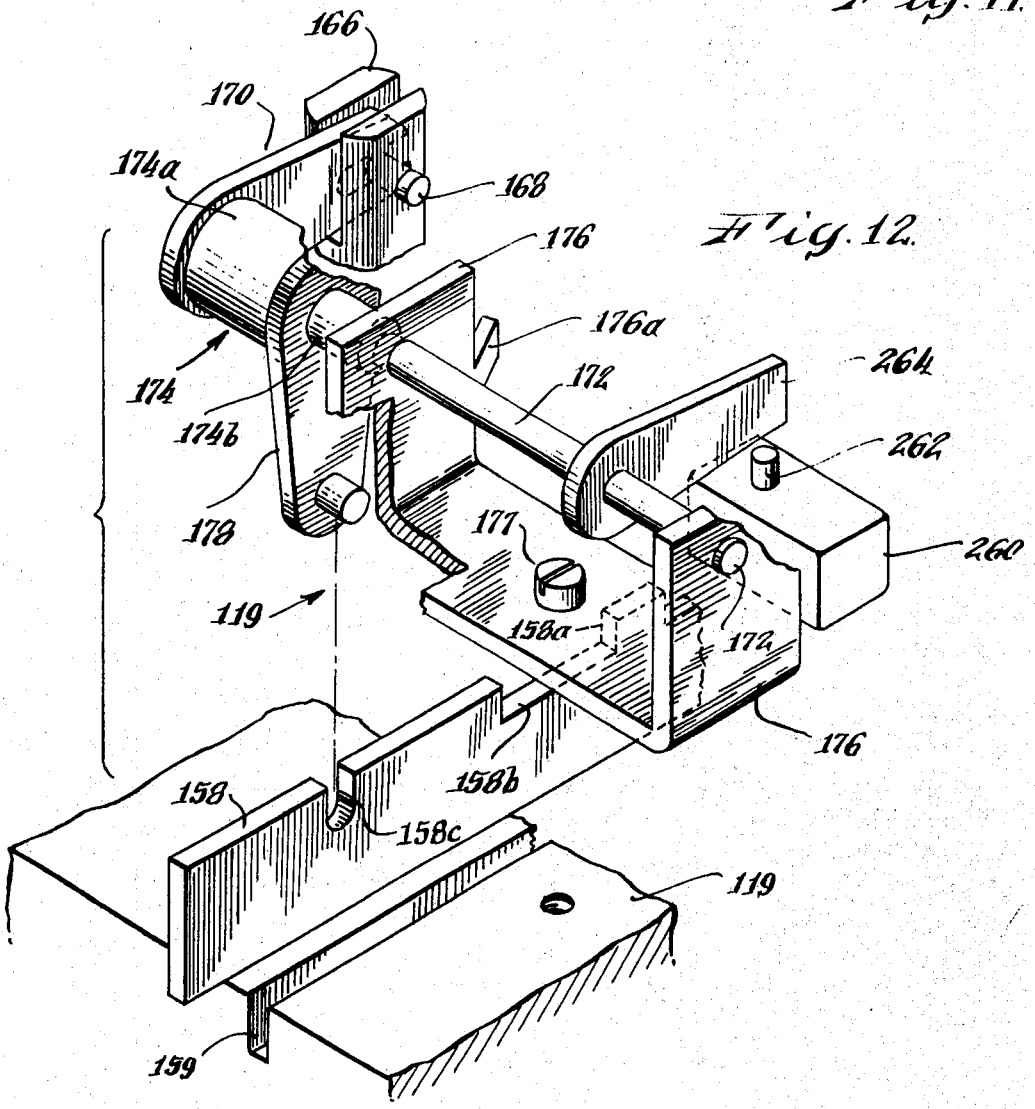
FIG. 12 is a perspective view of a locking mechanism for the postage printer of this invention.

As seen in FIG. 5, a locking comb 158 extends horizontally through the postage printing mechanism, and is horizontally slideable (see FIG. 3) between the upper guide block wing 120 and the print segments 94*a;* 94*b*, and also in a slot 159 milled in the central portion of the guide block 119 (see FIG. 12). The upper rear guide ribs 146 (FIGS. 8 and 9) of the print slugs 94*a;* 94*b* are located behind the locking comb 158 and move toward the locking comb during their forward print stroke (see FIGS. 3 and 4). The locking comb is formed with alternated teeth 158*a* and intervening recesses 158*b*. Sliding motion of the comb causes either the teeth 158*a* or the recesses 158*b* all to line up with the adjacent guide ribs 146, thus determining whether the print slugs 94*a;* 94*b* are blocked or are released to perform their printing stroke. A tension spring 161 is anchored at one end by an L-shaped bracket 162 secured to guide block 119, and is secured at its other end to the locking comb 158 for biasing it into the blocking position. The comb can only be moved into the releasing position by a solenoid 164 (FIGS. 3 and 5) on computer command. The solenoid 164 is received within recess in the upper guide block wing 120.

This solenoid has a plunger 166 which is provided with a connecting pin 168 captured between the fingers of a yoke 170 (see FIG. 12). The yoke in turn is staked on a shaft 172 which is journalled on a U-shaped bracket 176 secured to guide block 119 by a bolt 177. A drive link 178 has a connecting pin 180 which is received within a comb notch 158*c* as best seen in FIGS. 5 and 12. A bushing 174 is secured to the shaft 172 for rotation therewith. The bushing has a larger diameter 174*a* for spacing the members 170 and 178 apart, and a smaller diameter 174*b* to which the link 178 is staked. Thus, when the solenoid 166 is energized, the plunger 166 and pin 168 thereof rotate the yoke 170, the shaft 172 and the link 178 as a unit, causing the pin 180 to drive the locking comb 158 in the releasing direction, extending the comb return spring 161 (FIG. 5). The locking comb is seen in FIG. 5 in its releasing position, wherein the guide ribs 146 are free to move into the comb recesses 158*b* when the print slugs are actuated by their solenoids 124. Subsequently, when the electrical signal terminates, the solenoid 164 no longer holds the locking comb 158 in locking position. But the locking comb 158 cannot return to its biased position until after all the print segments 94*a;* 94*b* have returned, because until that time the guide ribs 146 are in the comb recesses 158*b*, interfering with the teeth 158*a*, and thereby preventing sliding motion of the comb 158. Eventually, however, the comb is biased back to its original position in which the teeth 158a are in blocking relationship to the guide ribs 146. Then it is no longer possible to move the print slugs 94*a;* 94*b* toward the platen 62. The locking comb 158 is retained in its slot 159 (FIG. 12) but a lug 176*a* bent laterally from bracket 176 (FIGS. 3 and 12), and by a shim 163 (FIG. 3) belted to the guide block 119.

The position of the actuating mechanism for the locking comb 158 is monitored electrically, to provide information which is useful for print confirmation purposes. As seen in FIGS. 3 and 12, a conventional double-pole, double-throw switch 260 is mounted on the guide block 119 and actuated by a plunger 262 located in the path of a lever 264 staked to the releasing shaft 172 of the locking comb 158. When shaft 172 rotates link 178 to release the locking comb, it also rotates lever 264 to strike the plunger 262 and actuate the switch 260. In an exemplary print confirmation circuit which is disclosed in the Eckert, et al application cited above, release of the locking comb produces a first output from the switch 260 which starts an operating cycle of the print confirmation circuit, and re-locking of the comb 158 produces a second output from the switch 260 (because it is a double-pole, double-throw device) which consummates the operating cycle of the print confirmation circuit. To avoid contact bounce problems, these outputs from switch 260 are preferably used to switch one or more latching circuits.

Test printing operations with the described mechanism, in which all the print solenoids 124 were fired substantially simultaneously, have demonstrated that such simultaneous firing noticeably degrades the print quality. Presumably this is because the supplemental printer 12 of this invention, which is small in relation to the conventional high speed printer 10 of FIG. 1, does not have sufficient reaction mass of its own, and cannot be mounted sufficiently rigidly on the high speed printer 10, to press the print slugs 94*a;* 94*b* firmly against the print surface under the shock of simultaneous firing. In accordance with an additional aspect of this invention, however, excellent print quality is obtained if the print solenoids 124 are fired sequentially, even if the spacing is no greater than 1 to 2 milliseconds between consecutive solenoid firings. Apparently this spreads the printing shock over a large enough time span to reduce the peak shock intensity, resulting in print quality which is not noticeably inferior to that obtained in low speed printing operations.

Figure 13:
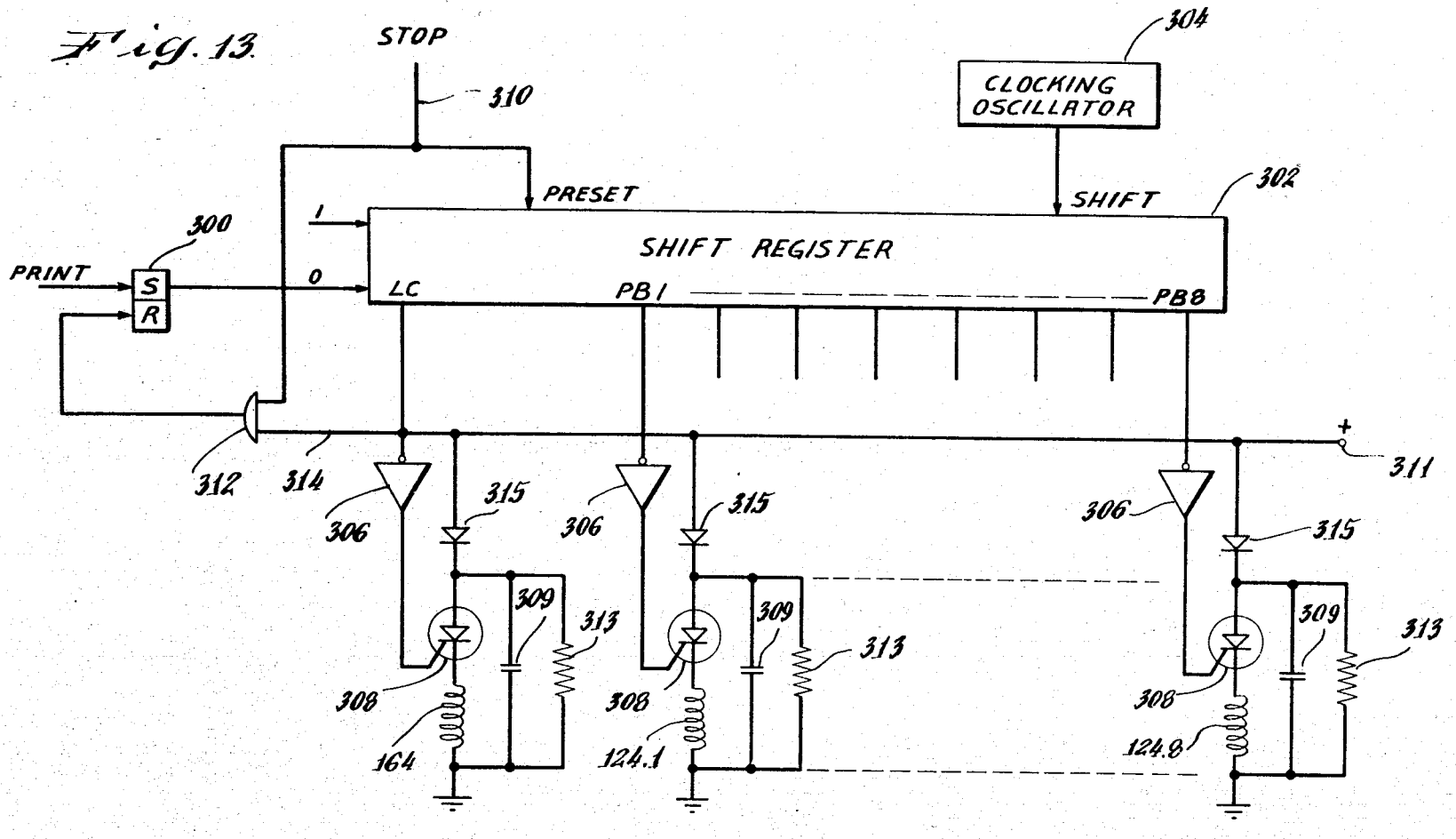
FIG. 13 is a schematic diagram of an electrical circuit for firing the print solenoids sequentially.

FIG. 13 illustrates an exemplary circuit which may be used for separating the print solenoid firing times in accordance with this invention. An externally generated print signal sets a start flip-flop 300, causing it to insert a zero into the first stage of a shaft register 302 which is continually shifted by a clocking oscillator circuit 304 having a period equal to the desired time spacing between print solenoid firings. The zero inserted into the first shift register stage is therefore propagated through each successive register stage.

The outputs from the successive shift register stages are labeled LC and PB1 through PB8 in that order, to indicate that they are connected to turn on the locking comb solenoid 164 and the print bail solenoids 124.1 through 124.8 respectively. Each shift register stage output LC and PB1-PB8 is connected through a respective inverter stage 306 to the gate of a respective SCR 308 wich controls energization of the respective solenoid 164 or 124.1–124.8. Because of the logical inversion introduced by stages 306, the SCR's 308 of solenoids 164 and 1124.1–124.8 are fired in that order as the initial zero is propagated along the shift register 302. The time delay between solenoid firings is determined by the clocking rate of the shift register, which in turn equals the frequency of the clocking oscillator 304.

The turning on of each SCR 306 in turn discharges a respective capacitor 309 through the associated solenoid 164 or 124.1 – 124.8. After discharging the capacitors 309, the SCR's 308 are turned off and the capacitors 309 are recharged from power terminal 311. The capacitor recharge time is preferably small enough so that, by the time print segments 94*a;* 94*b* return to home position and the number wheels 106 are reset, the print cycle can be repeated. Therefore, recharging the capacitors 309 is not a limiting factor so far as printing rate is concerned. Diodes 315 are employed to isolate the capacitors 309 from each other during print discharge. Resistors 313 are employed to protect the SCR's 308 from the inductive kick-back of solenoids 164 and 124.1–124.8 when the SCR's are turned off. FIG. 13 does not show any explicit provision for turning off the SCR's 308 after printing, in order to avoid unnecessary detail which forms no part of the present invention. Turning off of the SCR's must be done by momentarily opening their anode-cathode circuits after discharge of capacitors 309, as is well known in the art. Various circuits for accomplishing this are disclosed, for example, in the General Electric SCR Manual, 4th Edition.

When an external stop signal subsequently arrives over lead 310, it enables a coincidence gate 312 and presets the shift register 302 (i.e. forces all shift register stages to assume a logical one state). This assures that all the inverters 306 are turned off, and energizes a lead 314 connected to the output of the first shift register stage (LC). The signal on lead 314 then passes through the enabled gate 312 and resets the start flip-flop 300, concluding the print cycle.

The described solenoid-operated printing mechanism provides significant improvement in speed over prior art postage printers. It was pointed out above that the maximum number wheel resetting time is about 140 milliseconds. Once number wheel setting is accomplished, the time required to drive the print slugs 94*a*; 94*b* to impact and return them to reset position is of the order of 50–60 milliseconds, even allowing for the delaying effect of the time spread circuit in FIG. 13. Thus the maximum total cycle time is slightly over a quarter second even in the worst case (i.e. maximum number wheel setting displacement). Such a cycle time would permit a production rate of nearly four postage impressions per second, even if the number wheel setting displacement were always maximum. Statistically, the average number wheel setting displacement is much less than maximum for any normal distribution of postage amounts. Therefore under normal conditions the maximum production rate of this printer can exceed four postage impressions per second, which is better than twice as fast as the production rate of mechanically driven postage meters.

It will now be appreciated that the present invention provides a segmented, solenoid-actuated special purpose printer which is capable of speeds compatible with data processing equipment. The segments return to uneven home positions, to deter "wiping off". The printer employs a combination of variable information and fixed information printing means to combine variable amount information and a special validating symbol. This printing concept may be embodied in a supplemental printer mechanism physically mounted in piggy-back relationship upon an otherwise conventional computer output printer, which prints upon the same print-out sheet and in response to commands from the same computer. Print quality is preserved by spreading out the individual segment print impacts along the time axis. The piggy-back printer is useful in postage printing and various other applications requiring over-sized or non-standard printing symbols in a computer-controlled installation, or in any application where security problems are an important consideration.

Since the foregoing description and drawings are merely illustrative, the scope of protection of the invention has been more broadly stated in the following claims; and these should be liberally interpreted so as to obtain the benefit of all equivalents to which the invention is fairly entitled.

The embodiments of the invention in which an exclusive property or privilege is claimed are defined as follows:

1. A postage printer comprising, in combination:

a plurality of discrete impact segments arranged in a contiguous side-by-side relationship;

a flat platen;

means separately mounting each said segment for individual rectilinear movement between respective home positions and print impacting engagement with said platen;

separate actuating means operatively coupled to each said segment, each including a solenoid having an armature and a pivotally mounted bail operatively coupled to said armature, each bail having means forming a pair of substantially circular spaced apart projections located along the length thereof between said armature and the ball pivot point, said projections accommodated in a pair of circular recessses in each respective segment for converting the pivotally movement of said bail in response to solenoid actuation into rectilinear movement of its respective segment into print impacting engagement with said platen, each of said solenoid armature having a bifurcated end, said spaced bail elements of each bail converging into contiguous relation for entry into said armature bifurcated end, a drive pin bridging said bifurcated armature end to retain the converged portion of said bail therein, the depth of such said armature end bifurcation being sufficient to provide a lost motion coupling between said bail and said armature during print impacting engagement of the respective segment with said platen, said bail projections providing a laterally balanced drive coupling between each bail and each respective segment;

separate restoring means operatively coupled to each said segment for returning their respective segments to their respective home positions; and sequencing means coupled to the actuating means for causing said actuating means to drive the segments at a predetermined sequential rate, said sequencing means comprising a shift register, means for respectively coupling individual stages of said shift register to said separate actuating means, and a clocking means for shifting said shift register at a predetermined rate.

* * * * *

UNITED STATES PATENT AND TRADEMARK OFFICE

CERTIFICATE OF CORRECTION

PATENT NO. : 3,990,362

DATED : November 9, 1976

INVENTOR(S) : FRANK T. CHECK, GERALD C. FREEMAN & RAYMOND R. LUPKAS

It is certified that error appears in the above-identified patent and that said Letters Patent are hereby corrected as shown below:

Column 1, line 20, change "desireable" to --desirable--.
Column 5, line 63, change "rototably" to --rotatably--.
Column 8, line 28, remove the word "aligned".
Column 11, line 60, change "but" to --by--.
Column 12, line 56, change "1124.1" to --124.1--.
Column 13, line 33, change "reset" to --rest--.
Claim 1, Column 14, line 31, change "ball" to --bail--.
line 37, remove the word "of".
Claim 1, Column 14, line 34, "pivotally" should read -- pivotal --.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*